US008278835B1

(12) United States Patent
Radzinski et al.

(10) Patent No.: US 8,278,835 B1
(45) Date of Patent: Oct. 2, 2012

(54) MODULAR ELECTRONIC BALLAST

(75) Inventors: Christopher Radzinski, Huntsville, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 463 days.

(21) Appl. No.: 12/557,889

(22) Filed: Sep. 11, 2009

Related U.S. Application Data

(60) Provisional application No. 61/096,161, filed on Sep. 11, 2008.

(51) Int. Cl.
*H05B 41/16* (2006.01)
*H05B 41/24* (2006.01)

(52) U.S. Cl. .... 315/250; 315/246; 315/307; 315/DIG. 4

(58) Field of Classification Search ..... None
See application file for complete search history.

(56) References Cited

U.S. PATENT DOCUMENTS 6,107,755 A * 8/2000 Katyl et al. ..... 315/307
6,181,086 B1 1/2001 Katyl et al.
6,388,400 B1 5/2002 Noh
6,390,646 B1 5/2002 Yan
6,531,824 B1 3/2003 Yan
6,867,554 B2 3/2005 Ribarich et al.
7,009,348 B2 3/2006 Mogilner et al.
2007/0001617 A1 1/2007 Pogodayev et al.
2008/0019113 A1 1/2008 Smith
2008/0030144 A1 2/2008 Steckling
2008/0030146 A1* 2/2008 Chou et al. ..... 315/274

* cited by examiner

*Primary Examiner* — Anh Tran
(74) *Attorney, Agent, or Firm* — Waddey & Patterson, P.C.; Mark J. Patterson; Gary L. Montle

(57) ABSTRACT

A modular electronic ballast is provided for powering a fluorescent lamp. A motherboard is configured to receive an AC input signal, one or more supplemental input signals and a feedback signal from the lamp. A ballast control circuit generates an output signal for an oscillating inverter driving the lamps. A daughter card is coupled to the motherboard and selected from a plurality of daughter cards, each configured to provide a dimming control signal having predetermined characteristics and readable by the control circuit. The daughter cards are collectively configured to provide dimming control signals in response to each of a line-coupled demand response interface, one or more digitally addressable interfaces, analog dimming signals received via said supplemental communications bus, and three-wire phase control signals received via said AC line and said supplemental communications bus. The motherboard is configured to interchangeably receive any one of the daughter cards. The ballast control circuit is effective to generate output signals in response to the feedback signal, dimming control signal and a predetermined lamp output value.

16 Claims, 11 Drawing Sheets

| | 500 Demand Response | 600 Address Pro ® | 700 DAL1 | 800 SuperDim ® | 900 3-Wire Phase |
|---|---|---|---|---|---|
| J3:A | Line 1 | Line 1 | Line 1 | N/A | Line 1 |
| J3:B | N | N/A | N/A | N/A | N |
| J3:C | Line 2 | N/A | N/A | N/A | N/A |
| J3:D | N/A | Supp 1 | Supp 1 | Supp 1 | N/A |
| J3:E | N/A | Supp 2 | Supp 2 | Supp 2 | Supp 2 |

| | 500 Demand Response | 600 Address Pro ® | 700 DAL1 | 800 SuperDim ® | 900 3-Wire Phase |
|---|---|---|---|---|---|
| J4:A | N/A | 14 VDC | 14 VDC | N/A | N/A |
| J4:B | N/A | N/A | N/A | Iso. AC in | N/A |
| J4:C | 12Vin | 12Vin | 12Vin | 12Vin | 12Vin |
| J4:D | DIM | DIM | DIM | DIM | DIM |
| J4:E | GND | GND | GND | GND | GND |
| J4:F | GND | GND | GND | GND | GND |

*FIG. 4C*

712
C40
R70
R67
R68
R69
716
U13
718
718
716
720
714
GND
U11
700
VDC-12
710
J4F
J4E
J4D
J4C
J4B
J4A
GND
732
Dali
Interface
J3A
J3B
J3C
J3D
J3E
730
704
D18
D20
D23
D19
D21
D22
+5V
R59
718
R61
R58
C35
R60
Q8
Q9
702
D17
R62
C36
GND
GND

MODULAR ELECTRONIC BALLAST

CROSS-REFERENCES TO RELATED APPLICATIONS

This application claims benefit of the following patent application: U.S. Provisional Application No. 61/096,161, filed Sep. 11, 2008.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to dimming and non-dimming electronic ballasts for powering fluorescent lamps. More particularly, the present invention relates to modular designs for various electronic ballast interface protocols making use of a common power motherboard.

Many different electronic ballasts are required to meet the diverse needs of the marketplace. A large fraction of ballasts are traditional fixed light output (non-dimming) ballasts. For these types of products, cost is a critical aspect of the design. Smaller, but fast-growing quantities of ballasts require various types of dimming capabilities. Ballasts have different operating characteristics depending on operating line voltage, types and quantity of lamps supported. Additionally, many different dimming interfaces and control systems exist Certain ballasts have load shedding capabilities, where a remote signal may enable reduction of lighting energy consumption in response to peak or emergency grid events. A continuous dimming control protocol as known in the art, such as for example demand response protocols, provides optimal load management through AC power line-coupled control signals that may be received by the ballast for adjusting the lamp output accordingly. Demand Control Lighting (DCL®) is a proprietary example of such a ballast interface.

Ballasts may have automated continuous dimming capabilities where one or more ballasts connected in a loop receive digital control signals from a remote device capable of detecting for example ambient light conditions, and adjusting the lamp output levels in a manner known in the art as daylight harvesting.

Other ballasts as known in the art utilize digitally addressable interfaces, one example being DALI, an open industry standard protocol where various ballasts in a common loop may be individually controlled using device-specific addresses and digital control signals. AddressPro® is a proprietary example of such a ballast interface.

Still other ballasts as known in the art utilize phase control analog dimming, which provides a 1% to 100% dimming range using a phase control signal wire in combination with the hot and neutral AC mains line components, and/or various forms of an analog 0-10 VDC dimming range control signal. SuperDim® ballasts are a proprietary example of such a 0-10 Vdc protocol.

Present arrangements of these types of products require unique solutions such as printed circuit boards that are unique to each particular ballast and dimming protocol. Therefore, to meet market demands many different designs must be individually developed to support the varying needs. It would be desirable to provide a ballast design that could be separated into a dimming receiver and a power motherboard, such that many different ballast designs could rapidly be delivered by combining the common circuits. This would in turn enable lower development costs and more reliable final products.

BRIEF SUMMARY OF THE INVENTION

According to a first aspect of the present invention, a common power platform motherboard is established in conjunction with interchangeable secondary cards, or daughter cards, to support various existing and yet to be defined protocols. The modular aspects of the present invention allow for various interface protocols as are rapidly appearing in the lighting industry to be used with a wider product base. The motherboard is designed to function with or without any daughter cards, such that the motherboard provides closed loop control for a non-dimming ballast based on predetermined lamp output values, or may be configured to provide closed loop control for a dimming ballast based on a lamp dimming output value provided from a daughter card associated with the particular desired ballast interface.

The motherboard has a common platform for use with each of the daughter cards and may provide a lamp output signal for each type of ballast based upon the dimming signals produced by the daughter cards.

The motherboard is further configured to receive an AC mains power signal and one or more supplemental signals, and provide these signals to the daughter cards. The various daughter cards may then generate lamp dimming output values based on external control signals encoded within one or more of the AC mains or the supplemental signals, which may include digital or analog signals provided from a remote control source. The daughter cards may provide continuous dimming or light level switching in various aspects of the present invention.

Typical development cycles for traditional non-modular ballast techniques take about nine to ten months. Using a modular ballast development technique in accordance with the present invention, the development expense can be reduced by approximately fifty percent where "known good" modules are used to configure a new product. The additional material costs are only on the order of two percent higher using this modular ballast approach.

In an embodiment of the present invention, a modular electronic ballast is provided for powering a fluorescent lamp. A motherboard is configured to receive an AC input signal, one or more supplemental input signals and a feedback signal from the lamp. A ballast control circuit generates an output signal for an oscillating inverter driving the lamps. A daughter card is coupled to the motherboard and selected from a plurality of daughter cards, each configured to provide a dimming control signal of a predetermined range and readable by the control circuit. The daughter cards are collectively configured to provide dimming control signals in response to each of a digital demand response interface, a digital continuous dimming interface, a DALI interface, analog dimming signals received via said supplemental communications bus, and three-wire phase control signals received via said AC line and said supplemental communications bus. The motherboard is configured to interchangeably receive any one of the daughter cards. The ballast control circuit is effective to generate output signals in response to one or more of the feedback signal, dimming control signal and a predetermined lamp output value.

In another embodiment, a printed circuit board is provided that is configurable for use with various dimming electronic ballasts and fixed light output ballasts. A first input circuit is coupled to receive an AC input signal transmitted across a power line. A second input circuit is configured to receive supplemental input signals transmitted via one or more supplemental buses. A feedback circuit detects a lamp feedback signal from a fluorescent lamp. A ballast control circuit is configured to receive the AC input signal and said lamp feedback signal, and further generates a ballast control signal which is transmitted to control the lamp output. An auxiliary module is configured to receive a secondary dimming card, with an input portion configured to provide at least one of the AC input signal and the supplemental input signal to the secondary dimming card, and also an output portion configured to provide a lamp dimming signal to the ballast control circuit from the secondary card. The generated ballast control signal is dependent on the lamp feedback signal and either of the lamp dimming signal or a predetermined lamp output value, depending on whether or not the secondary card is coupled to the printed circuit board.

In another embodiment, an electronic ballast is provided for powering one or more fluorescent lamps. The ballast is coupled to receive an AC signal from an AC power line. The ballast includes a power motherboard that may be configured to generate a lamp output control signal based upon at least one of: (a) a feedback signal from the one or more lamps compared with a predetermined lamp output value, where the ballast is non-dimming in orientation; and (b) the feedback signal from the one or more lamps compared with a lamp output value provided by a daughter card coupled to the motherboard where the ballast is dimming in orientation. The lamp output value is generated by the daughter card in response to one or more external control signals associated with the ballast.

In various embodiments of the present invention, the daughter cards are collectively configured such that each of a desired plurality of ballast interface protocols are compatible with any given motherboard. Such ballast interface protocols may include but are not exclusively limited to demand response, AddressPro®, Digital Addressable Lighting Interface, SuperDim®, and three-wire phase control.

BRIEF DESCRIPTION OF THE SEVERAL VIEWS OF THE DRAWINGS

FIG. 4C is a table showing output connections for the plurality of daughter cards configurable with the power motherboard of FIGS. 4A, 4B.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal.

Referring generally to FIGS. 1-8, various embodiments of a design for power motherboards and daughter cards for use with a variety of electronic ballasts will herein be described.

Figure 1:
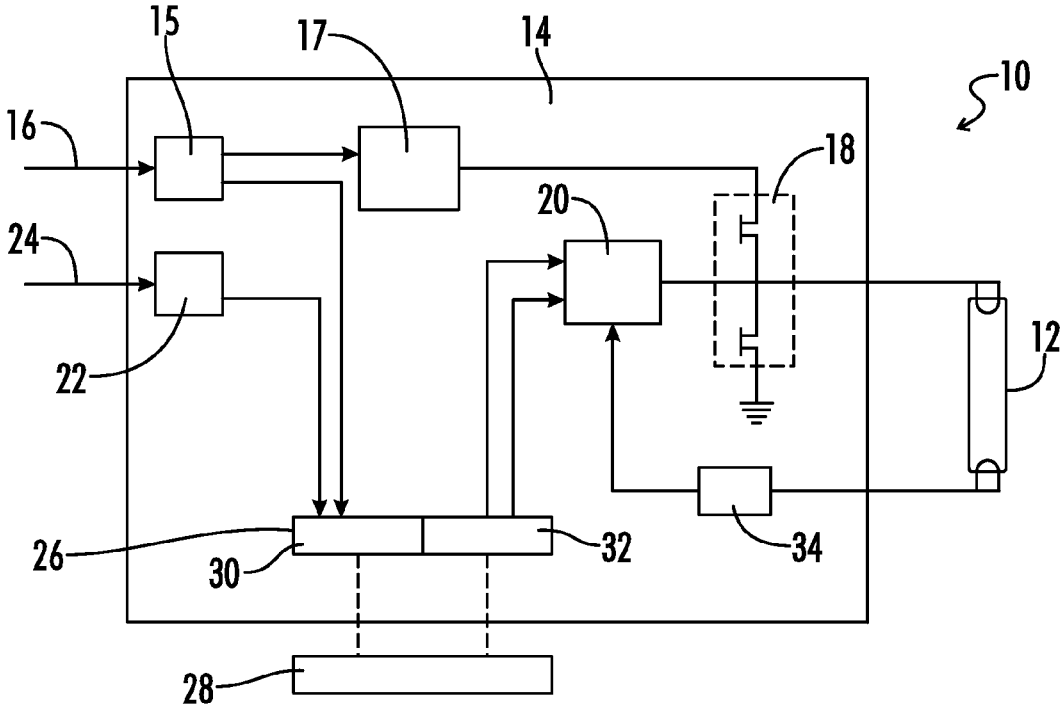
FIG. 1 is a block diagram of an embodiment of a modular electronic ballast of the present invention.

Referring now to FIG. 1, an electronic ballast 10 is provided for powering one or more fluorescent lamps 12. The ballast 10 includes a printed circuit board 14, which in various embodiments is a common power platform motherboard 14, having a first input circuit 15 configured to receive an AC input signal from an AC mains power line 16. The AC input signal is rectified by a rectifier as known in the art (not shown) to provide a DC signal for a power factor correction (PFC) circuit 17. The PFC circuit 17 adjusts the power factor of the ballast 10 for optimal efficiency and maximizing power delivered to the one or more lamps 12. The PFC circuit 17 is configured to provide a signal to an oscillating inverter circuit 18 which may include a pair of switches for regulating power delivered to the lamps 12. The inverter circuit 18 may further include many additional features such as fault detection or feedback circuitry as known in the art.

A ballast control circuit 20 generates and provides lamp output signals for switching operation of the oscillating inverter circuit 18. The motherboard 14 or primary circuit board 14 may in various embodiments include the inverter circuit 18 as shown, or may provide lamp output signals to a separate inverter circuit 18 within the scope of the present invention. The ballast control circuit 20 as shown includes a microprocessor 20 that provides pulse signals to the inverter circuit 18 controlling for example startup, shutdown, and dimming for the one or more lamps 12. The microprocessor 20 may in various embodiments store a predetermined lamp output value or reference value for control purposes. The predetermined lamp output value may for example be detectable from ballast circuitry, programmable during commissioning or remotely adjustable. A feedback circuit 34 is provided to detect a feedback signal from the lamps 12 corresponding to an actual voltage and/or current across the lamps 12 and thereby facilitating closed loop control functions for the ballast control circuit 20.

The motherboard 14 as shown includes a second input circuit 22 which may be coupled to a supplemental communications bus 24 and receive various supplemental signals. The bus 24 is generally not necessary for non-dimming ballast applications, as well as certain dimming applications, and the motherboard 14 may be fully functional without its presence. The supplemental signals may be provided across one or more conductors and may include any signals that are associated with control of a particular type of ballast as further described below. The second input circuit 22 of the motherboard 14 generally does not perform any processing functions but merely serves to direct the received signals to other components configured to receive and process them.

The motherboard 14 further includes an auxiliary module 26 shaped and configured to physically receive any one of a plurality of daughter cards 28 or secondary dimming cards 28. The motherboard 14 is capable of functioning without the presence of any secondary dimming card 28, such as with a non-dimming ballast application, but may otherwise not be able to provide dimming signals to the ballast 10.

The auxiliary module 26 has an input portion 30 configured to provide the AC signal and the supplemental signals from the motherboard 14 to the daughter card 28. The auxiliary module 26 also has an output portion 32 configured to provide a lamp dimming signal from the daughter card 28 to the motherboard 14. The input and output portions 30, 32 may be hardwired within the auxiliary module 26 so as to establish a connection with the daughter card 28 upon physically receiving the card 28, and may also include jumpers, cables, or other equivalent connectors as known in the art. The auxiliary module 26 is generally fully configured to receive any of the plurality of different daughter cards 28, as all necessary input and output connections are provided on the common platform.

The ballast control circuit 20 in various embodiments is configured to receive an analog lamp dimming control signal from a daughter card 28 for use in closed loop control. The daughter cards 28 are generally configured such that each card 28 provides an analog signal within the given range and readable by the ballast control circuit 20. The given range in an embodiment as shown is 0-5 Vdc, but may be provided from 0-10 Vdc, 0-3.5 Vdc, or various other ranges as may be understood by one of skill in the art. Alternatively, a set analog signal may be provided with respect to a reference signal provided from the motherboard to indicate a lamp dimming control signal within the scope of the present invention.

In alternative embodiments, the daughter cards 28 may collectively be configured to provide a pulse-modulated lamp dimming signal to the motherboard 14, with the motherboard 14 having circuitry to receive the pulse-modulated signal and convert it to an analog signal within the given range and readable by the ballast control circuit 20. Such circuitry may for example include an RC circuit or other equivalent designs as known in the art. The pulse-modulated lamp dimming signals may also within the scope of the present invention include pulse-width-modulated signals or pulse density dimming signals as known to one of skill in the art.

Referring generally now to FIGS. 2-4B, the input and output requirements for the motherboard 14 and the daughter cards 28 may be described in accordance with various embodiments of the present invention.

Figure 2:
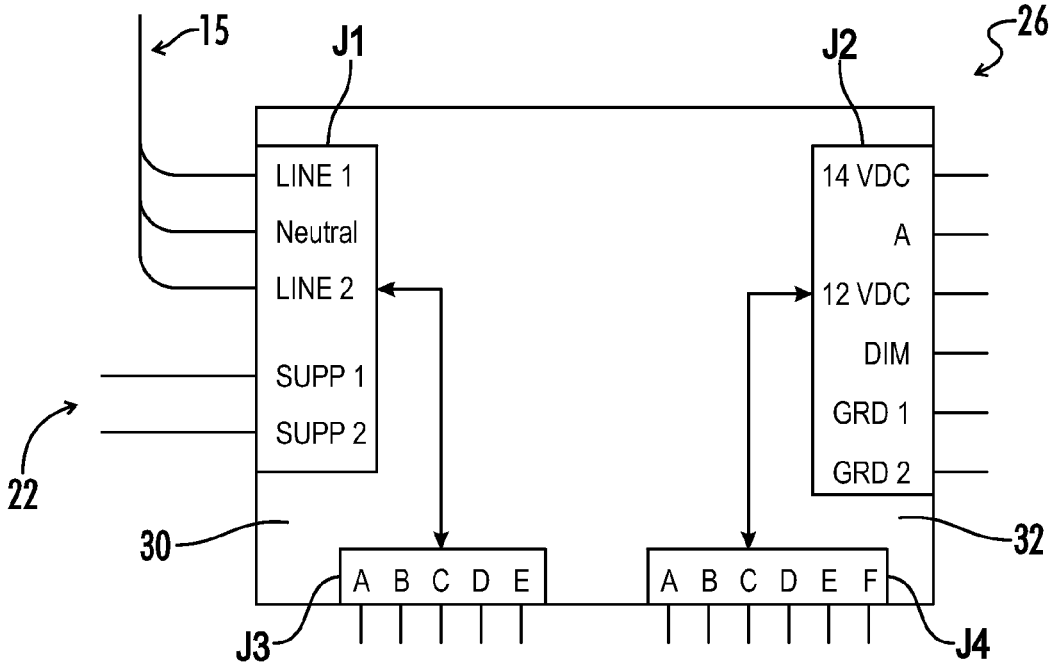
FIG. 2 is a schematic of input and output portions of an auxiliary module of the ballast of FIG. 1.

FIG. 2 shows a pair of terminals J1, J3 located on the input portion 30 of the auxiliary module 26, and a pair of terminals J2, J4 located on the output portion 32 of the auxiliary module 26. Terminal J1 receives the AC input signals (Line1, Neutral, Line2) from the first input circuit 15 and the supplemental signals (S1, S2) from the second input circuit 22. Terminal J3 receives the signals from Terminal 1 and is configured to provide the signals across pins J3:A to J3:E. Terminal J4 contains six pins labeled J4:A to J4:F and is configured to provide certain signals to the daughter card 28 and to receive other signals from the daughter card 28, most notably the lamp dimming control signal DIM. Terminals 1 and 2 may be merely illustrative, as the corresponding wires could connect directly to Terminals 3 and 4 without any intervening connections.

Figures 3A, 3B:
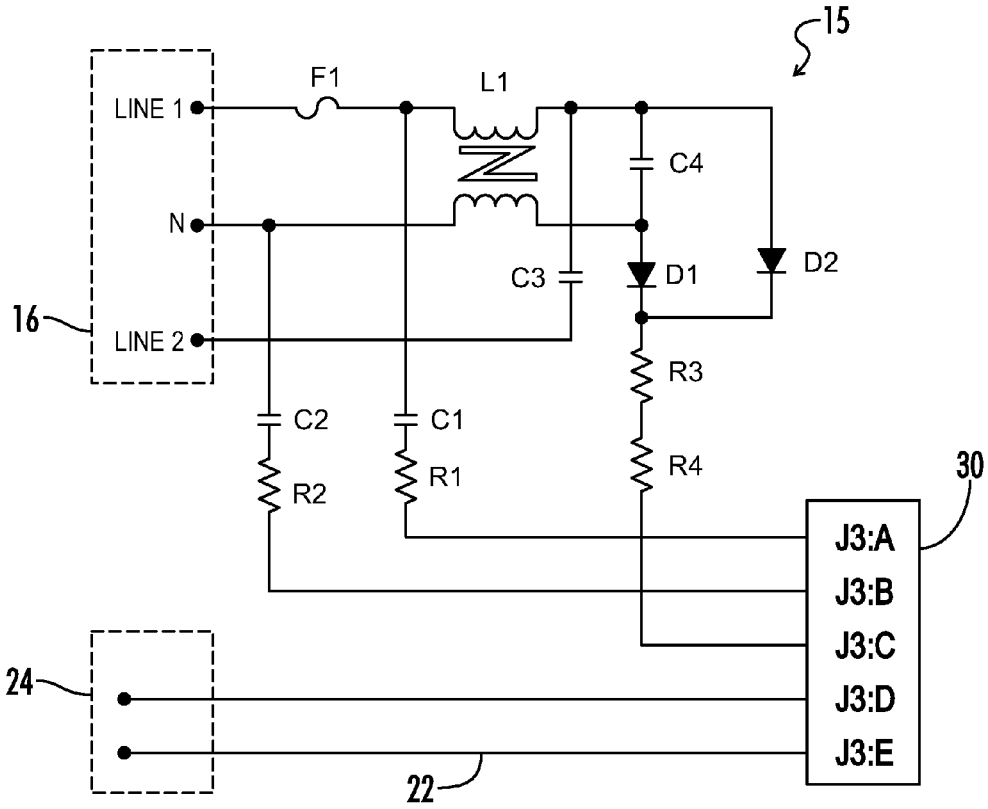
FIG. 3A is a circuit schematic showing an exploded portion of an embodiment of a power motherboard of the present invention providing signals to an auxiliary module.
FIG. 3B is a table showing input connections for a plurality of daughter cards configurable with the power motherboard of FIG. 3A.

FIG. 3A shows a detailed schematic view of a first input circuit 15 and second input circuit 22 of an embodiment of a motherboard 14 coupled to the AC power line 16. Various filtering components F1, L1, C3, C4 are provided in the first input circuit 15 to remove high frequency transients that may be included within the AC signal provided across the AC power line. J3:A is coupled to Line1 via capacitor C1 and resistor R1. J3:B is coupled to Neutral via capacitor C2 and resistor R2. Line1 and Neutral are coupled to a first side of opposing windings of transformer L1, with J3:C coupled to Line2 on a second side of transformer L1 via resistors R3, R4, filtering capacitors C3, C4 and diodes D1, D2. J3:D and J3:E are coupled directly to the supplemental signals Supp1, Supp2. In various embodiments the specific configuration and filtering circuitry of the input circuits 15, 22 may foreseeably vary within the scope of the present invention.

The plurality of daughter cards 28 are each configured for coupling to the motherboard, with the auxiliary module 26 effective to transmit and receive all signals necessary to interface with the desired dimming interface and communications protocols. In various embodiments the daughter cards 28 are collectively configured such that a common and standard lamp dimming control signal may be provided to the motherboard 14 in response to each of a digitally addressable interface, an AC power line-coupled interface, remotely transmitted analog input 0-10 volt DC control signals and remotely transmitted analog three-wire phase control signals. The daughter cards 28 may be removeably detachable to the auxiliary module 26 such that the assembly as a whole may be interchangeable in response to user specifications or ballast requirements.

Figures 5, 5A:
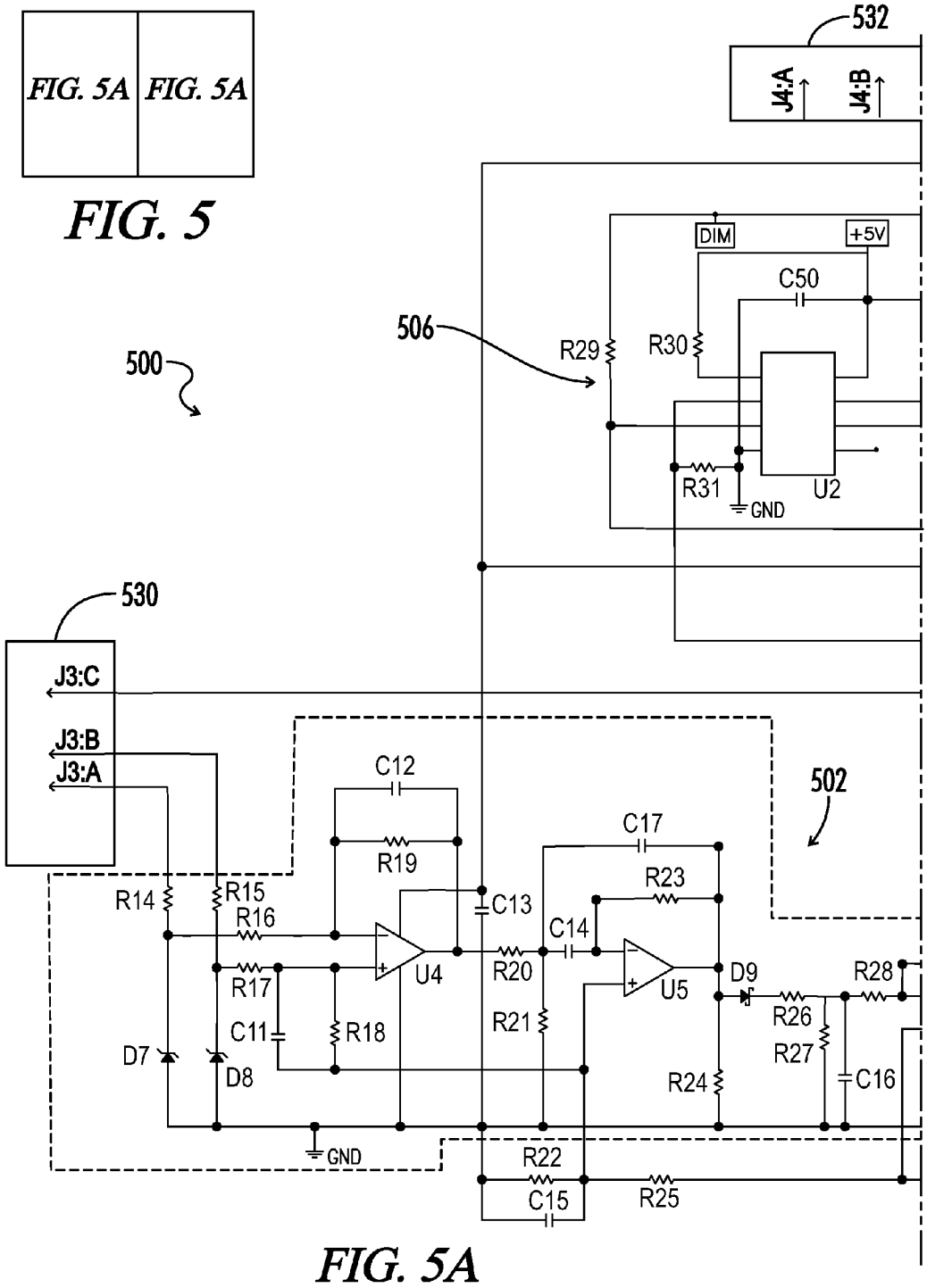
FIG. 5 is a circuit schematic of a demand response interface daughter card of an embodiment of the present invention.
Figure 5B:
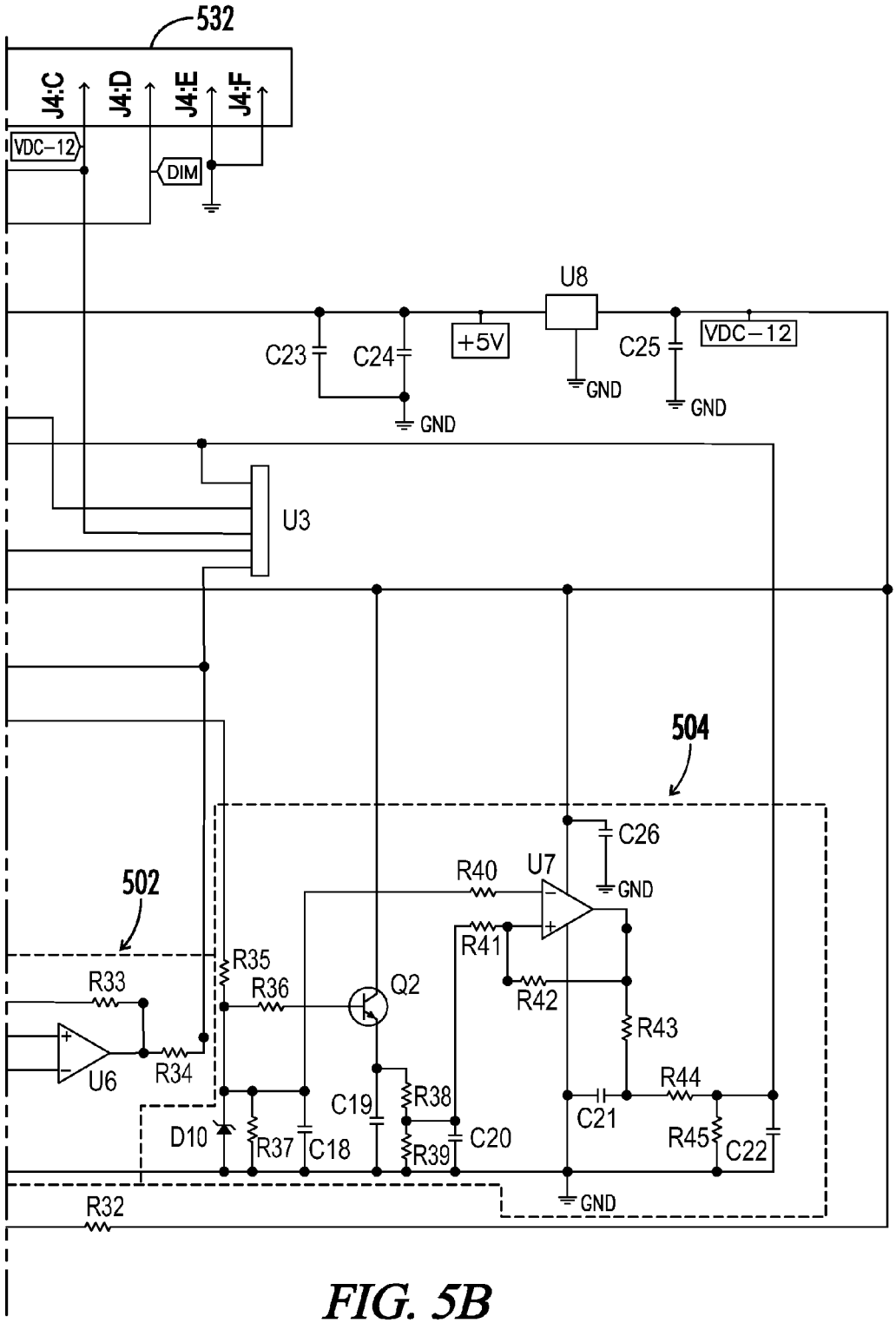
Figure 6:
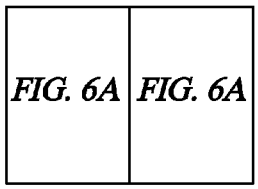
FIG. 6 is a circuit schematic of an AddressPro® interface daughter card of an embodiment of the present invention.
Figure 6A:
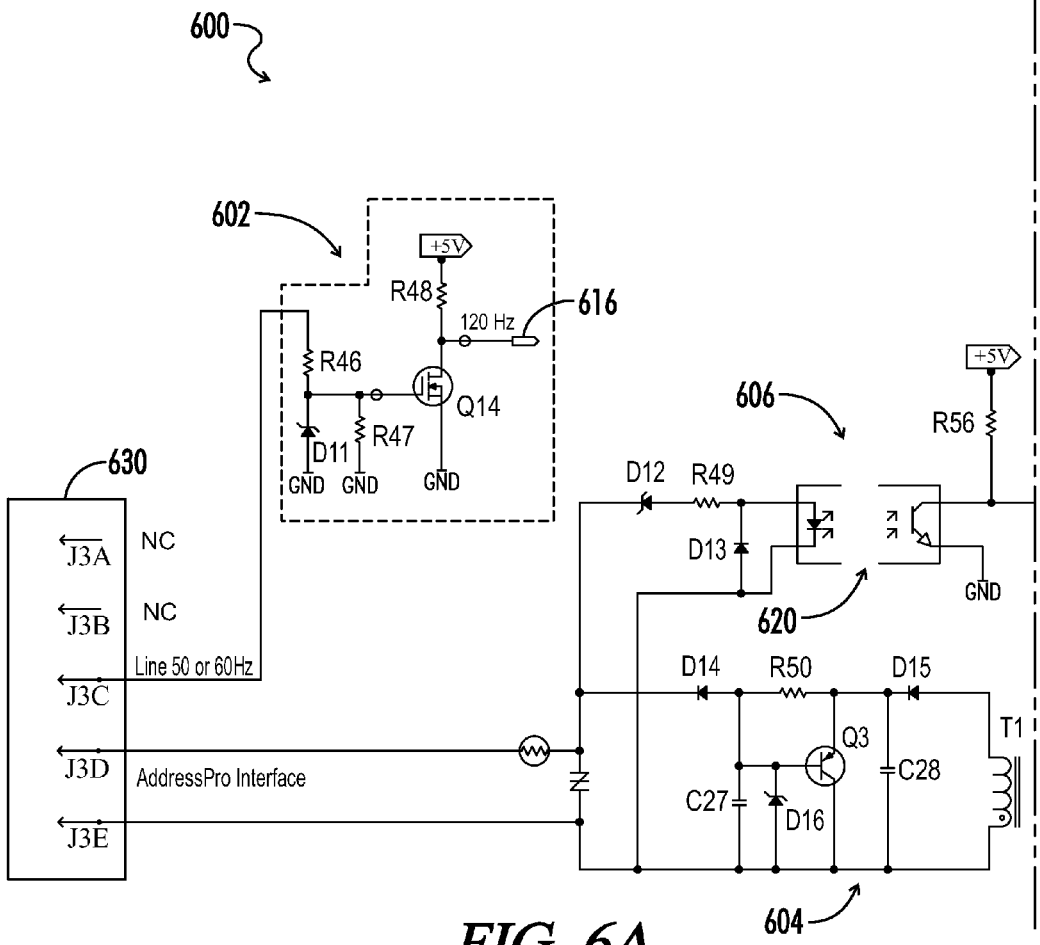
Figure 6B:
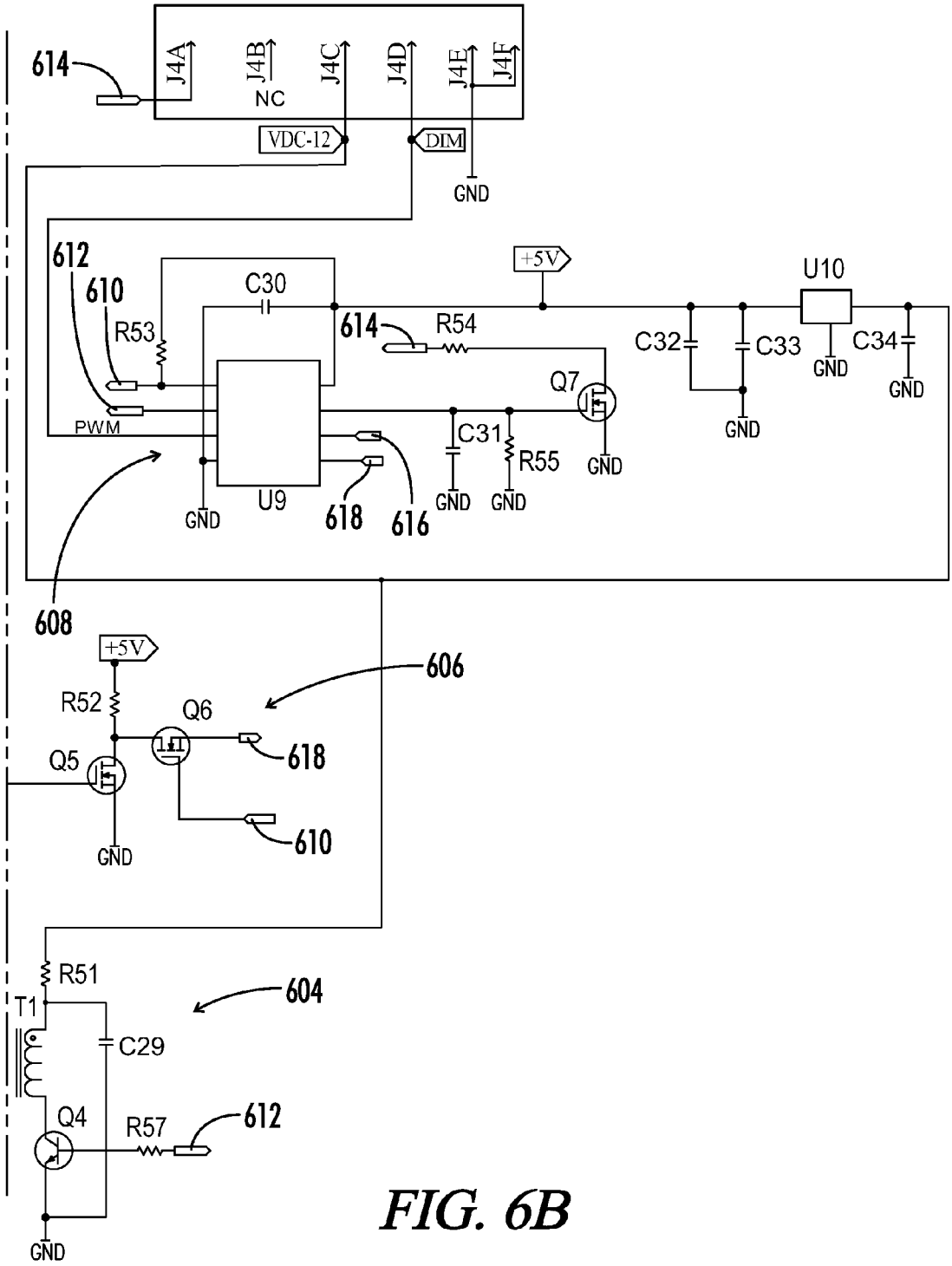
Figures 7, 7A:
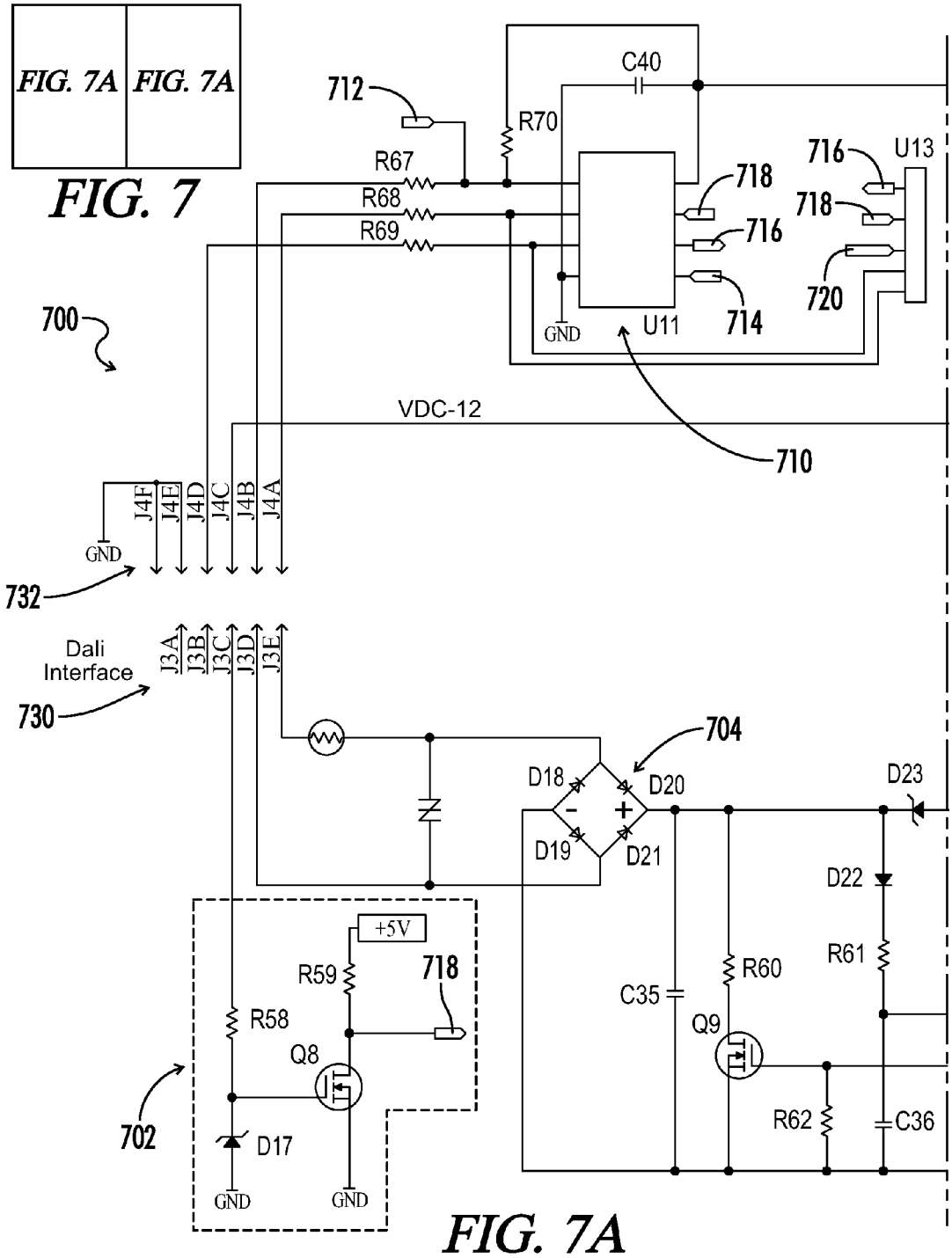
FIG. 7 is a circuit schematic of a DALI interface daughter card of an embodiment of the present invention.
Figure 7B:
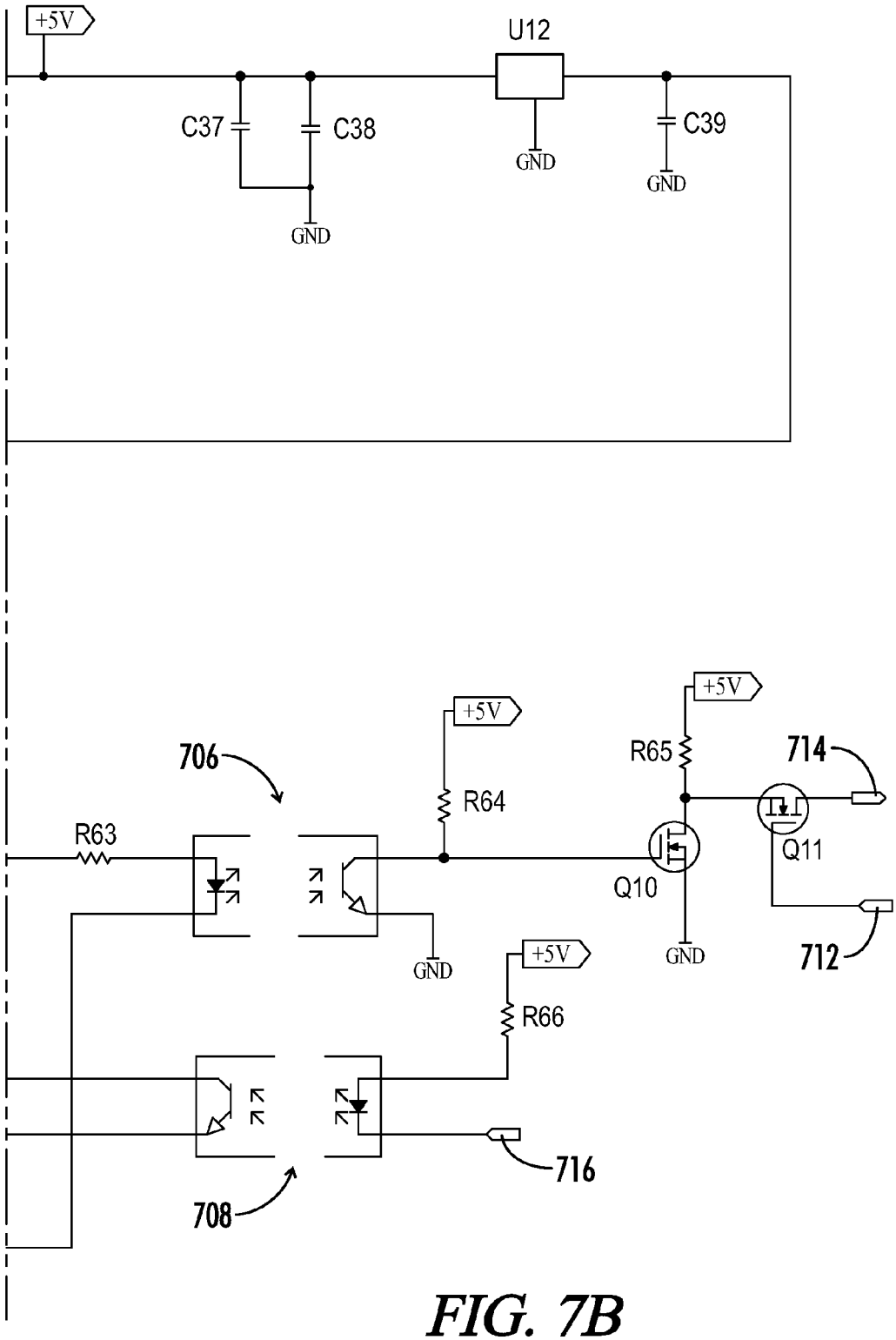
Figure 8:
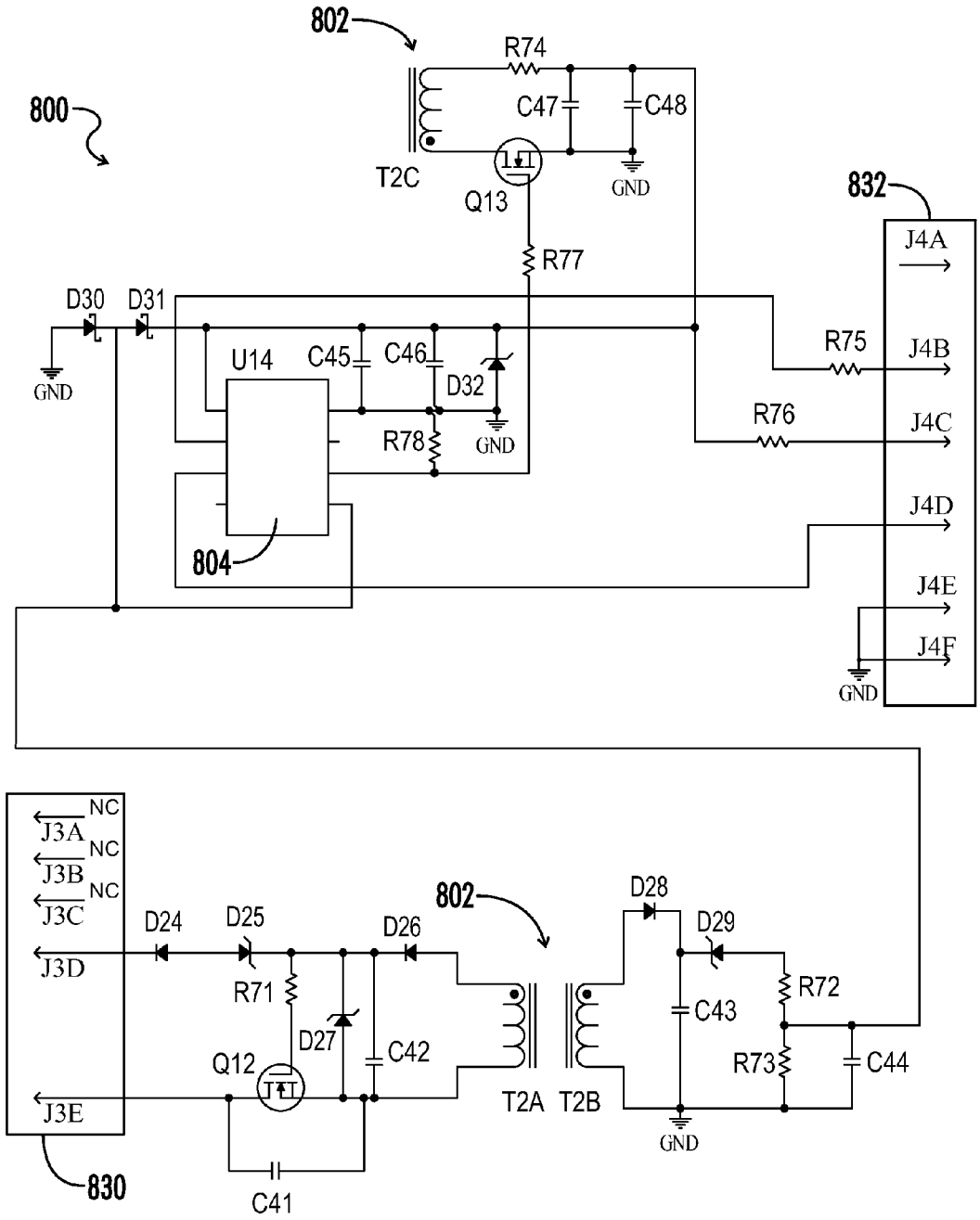
FIG. 8 is a circuit schematic of a SuperDim® daughter card of an embodiment of the present invention.

FIG. 3B shows input connections for various daughter cards 28 compatible with a motherboard 14 in an embodiment of the present invention. The first card 500 in this example, as further described below and with reference to FIG. 5, represents a demand response interface protocol requiring all three AC signal components Line1, N, Line2, and no supplemental inputs. The second card 600, as further described below and with reference to FIG. 6, represents an AddressPro® interface protocol requiring only the first AC signal component Line1 and two supplemental signals Supp1, Supp2, which in this example are digital signals specific to the AddressPro® interface. The third card 700, as further described below and with reference to FIG. 7, represents a Digital Addressable Lighting Interface (DALI) interface protocol requiring the first AC signal component Line1 and two supplemental signals Supp1, Supp2 which in this example are digital signals specific to the DALI interface. The fourth card 800, as further described below and with reference to FIG. 8, represents an analog protocol such as SuperDim® requiring only the two supplemental signals Supp1, Supp2, which in this example are analog 0-10 volt DC signals. The fifth card 900 represents an analog phase-control protocol requiring the first two AC signal components Line1, N, and a single supplemental signal Supp2 which in this example is a phase-control signal.

Various alternative protocols may be further anticipated using the described AC signal components and supplemental signals, and the five specific examples presented herein are in no way intended as limiting on the scope of the present invention. For example, a two-wire phase control protocol may be anticipated as making use of an AC power line-coupled control signal without the third input from a supplemental signal that is required in the disclosed three-wire embodiment. Another example may be Digital Multiplex interfaces (DMX) which could use the two supplemental input signals in a similar fashion with the SuperDim® protocol. Further, it may be understood that various alternative input signal combinations are possible for a particular interface, and the stated combination is intended as being illustrative of a particular example only.

Figure 4A:
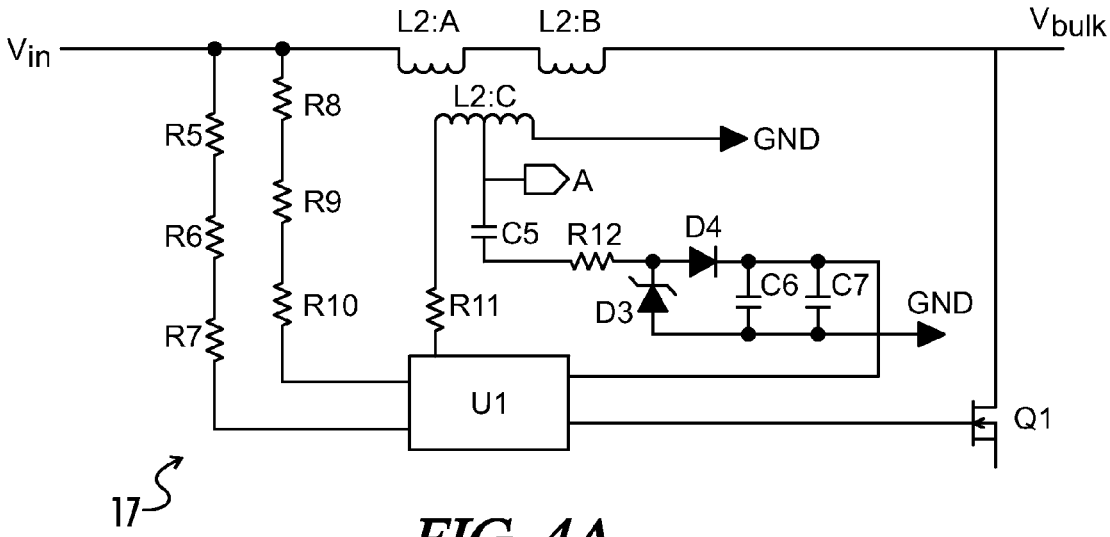
FIG. 4A is a circuit schematic showing an exploded portion of a power factor correction controller of an embodiment of a power motherboard of the present invention.
Figure 4B:
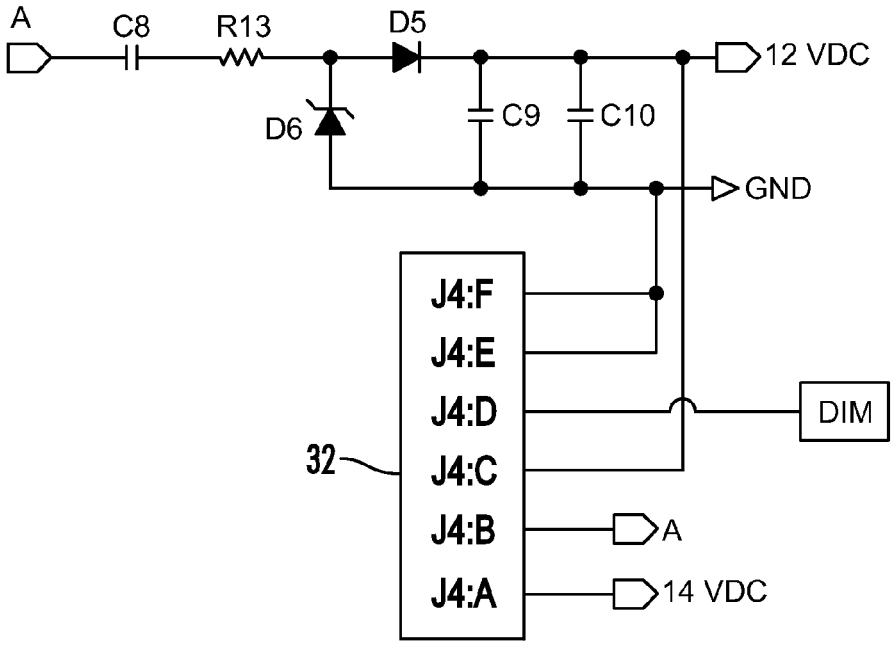
FIG. 4B is a circuit schematic in conjunction with FIG. 4A showing various input and output signals into an auxiliary module of the motherboard.

FIGS. 4A, 4B show further detailed schematics of a portion of the motherboard 14 in accordance with various embodiments of the present invention. FIG. 4A shows circuitry associated with the power factor correction controller 17 of the motherboard, most notably rectified line voltage Vin, boost transformer L2, integrated circuit U1, MOSFET Q1 and isolated AC input voltage A. FIG. 4B shows circuitry which in conjunction with FIG. 4A provides analog reference signals to the output portion 32 of the auxiliary module 26. FIG. 4C shows connections on the various daughter cards 28 with regards to the output portion 32 of the auxiliary module 26 of the motherboard 14 in an embodiment of the present invention. The output portion 32 in this example includes the lamp dimming signal across J4:D as provided by the daughter cards 28, but does not refer exclusively to output signals, as several pins may be used to transmit references voltages for example from the motherboard 14 to the daughter card 28. J4:A provides a 14Vdc signal from the daughter card 28. J4:B provides the isolated AC input signal to the daughter card 28. J4:C provides a 12Vdc reference signal. J4:E and J4:F are connected to ground.

Operation of the electronic ballast 10 with a power motherboard 14 in accordance with features of the present invention may now be described. Various aspects of an electronic ballast will not be discussed as being generally known to those of skill in the art, while various additional aspects may be related as relevant to the features of the invention even though not distinctly claimed.

For non-dimming ballasts 10, the motherboard 14 may conduct closed-loop control without requiring the presence of a daughter card 28. A predetermined lamp output value may be provided to the motherboard 14 and stored in the ballast control circuit 20. The ballast control circuit 20 provides output signals to the inverter circuit 18 based on the predetermined value and the feedback signal received from the one or more lamps 12.

For dimming ballasts, the motherboard 14 of the present invention will be coupled with one of a plurality of daughter cards 28 for which the motherboard 14 is commonly configured. The ballast control circuit 20 receives a lamp dimming signal from the coupled daughter card 28 and the feedback signal from the one or more lamps 12. The lamp dimming signal is of a common protocol that is produced by any of the plurality of daughter cards 28 that are coupled to the motherboard 14 and is readable by the motherboard 14. In various embodiments the lamp dimming signal may be an analog voltage reference as previously described, such as in one example a 0-5 Vdc signal, and in alternative embodiments may be a pulse-modulated signal that is converted on the motherboard itself into an analog signal of a given range. The feedback signal may be an average current across the lamps 12 which is converted into a voltage at a voltage controlled oscillator for regulating the inverter circuit 18. When a lamp dimming signal is received that varies from the feedback signal, the ballast control circuit 20 modulates the lamp output signal in accordance with the comparison. The lamp output signal in various embodiments may be adjusted by pulse frequency modulation, pulse width modulation or other equivalent methods as known in the art and within the scope of the present invention.

FIGS. 5-8 refer to various daughter cards 28 configured for specific electronic ballast interface protocols 10 and with the common power platform motherboard 14 of the present invention.

FIG. 5 shows a schematic for a demand response daughter card 500. The daughter card 500 receives at input terminal 530 three components (Line1, N, Line2) of an AC signal transmitted to the ballast across an AC mains power line and generates a dimming control signal based on a line-coupled dimming signal provided therein from a remote source such as for example a demand response controller. The card 500 generally includes a first amplifier circuit 502 coupled to the hot and neutral line components Line1, N, a second amplifier circuit 504 coupled to line component Line2, and an integrated circuit 506. The dimming control signal is provided to the motherboard via output terminal 532.

FIG. 6 shows a schematic for a daughter card 600 functional for continuous dimming with an AddressPro® interface. The card 600 receives at input terminal 630 one component of an AC mains signal and two supplemental signals that make up the digital AddressPro® interface. The card 600 generally includes a hardware platform that uses RXD receive signal 618 and further includes a frequency synchronization circuit 602, a flyback circuit 604, an optically isolated switch circuit 606 and an integrated circuit 608. Dimming control signals having the same characteristics as those provided by the demand response card 500 are generated based on these signals and provided to the motherboard 14 across an output terminal 632.

FIG. 7 shows a schematic for an embodiment of a daughter card 700 functional for continuous dimming with a Dimming Addressable Lighting Interface (DALI interface). The card 700 receives one component of an AC mains signal and two supplemental signals that make up the digital DALI interface at 730. The card 700 generally includes a hardware platform for the DALI protocol that uses RXD receive and TXD transmit signals 714, 716 and further includes a frequency synchronization circuit 702, a bridge rectifier 704, two optically isolated switches 706, 708 and an integrated circuit 710. Dimming control signals having the same characteristics as those provided by the previous cards 500, 600 are generated by the microprocessor based on these signals and provided to the motherboard 14 at output terminal 732.

FIG. 8 shows a schematic for a daughter card 800 functional for continuous dimming with a SuperDim® interface. The card 800 receives at input terminal 830 two supplemental signals that provide 0-10 VDC control input from a remote controller source (not shown), and generally includes an isolation transformer 802, an isolated AC reference received from the motherboard at pin J4:B and an integrated circuit 804. Dimming control signals having generally the same characteristics as those provided by the previous cards 500, 600, 700 are generated based on these signals and provided to the motherboard 14 across output terminal 832.

The previous detailed description has been provided for the purposes of illustration and description. Thus, although there have been described particular embodiments of the present invention of a new and useful "Modular Electronic Ballast," it is not intended that such references be construed as limitations upon the scope of this invention except as set forth in the following claims.

What is claimed is:

1. An electronic ballast for powering one or more fluorescent lamps, the ballast comprising:

a primary circuit board further comprising an AC input circuit coupled to receive an AC signal transmitted via an AC mains power line, a supplemental input circuit configured to receive one or more supplemental signals transmitted via a supplemental communications bus, a lamp feedback circuit effective to detect a feedback signal across said one or more lamps, a ballast control circuit effective to generate an output signal for an oscillating inverter coupled to said one or more lamps; and a secondary card detachably coupled to said primary circuit board and selected from a plurality of secondary cards, each of said plurality of secondary cards configured to provide a dimming control signal of a predetermined range and readable by said ballast control circuit, said secondary cards collectively configured to provide dimming control signals in response to each of a digitally addressable interface for providing continuous dimming, an AC power line-coupled demand response interface, analog dimming signals received via said supplemental communications bus, and three-wire phase control signals received via said AC line and said supplemental communications bus;

wherein said primary circuit board is configured to interchangeably receive any one of said secondary cards, and wherein said ballast control circuit is effective to generate said output signal in response to said feedback signal, said dimming control signal and a predetermined lamp output value.

2. The ballast of claim 1, each of said secondary cards configured to generate an analog dimming control signal.

3. The ballast of claim 1, each of said secondary cards configured to generate a pulse-modulated dimming control signal, said primary circuit board further comprising circuitry to convert said dimming control signal into an analog dimming control signal.

4. The ballast of claim 1, said AC power line further comprising a plurality of AC signal conductors and said supplemental bus further comprising a plurality of supplemental signal conductors, said secondary card configured to generate said lamp dimming signal by transforming signals provided with at least one of said AC signal conductors and at least one of said supplemental signal conductors.

5. The ballast of claim 1, said primary circuit board comprising one auxiliary module configured to receive any one of said plurality of secondary cards.

6. The ballast of claim 1, said primary circuit board comprising a plurality of auxiliary modules configured to receive a plurality of secondary cards, only one of said cards configured to receive and transmit signals at a particular time.

7. A printed circuit board configurable for use with various dimming electronic ballasts and fixed light output ballasts, said circuit board comprising:

a first input circuit coupled to receive an AC input signal transmitted via an AC power line;

a second input circuit configured to receive supplemental input signals transmitted via one or more supplemental buses;

a feedback circuit coupled to detect a lamp feedback signal from a fluorescent lamp;

a ballast control circuit configured to receive a predetermined lamp output value and said lamp feedback signal, and further configured to generate a ballast control signal and transmit said ballast control signal to said lamp;

an auxiliary module configured to receive a daughter card, said module having an input portion configured to provide at least one of said AC input signal and said supplemental input signal to said daughter card, said module further having an output portion configured to provide a lamp dimming signal to said ballast control circuit from said daughter card; and wherein said generated ballast control signal is dependent on said lamp feedback signal and either of said lamp dimming signal or said predetermined lamp output value.

8. The printed circuit board of claim 7, said daughter card configured to provide pulse-modulated lamp dimming signals, said motherboard including circuitry effective to transform said pulse-modulated signals into analog lamp dimming signals.

9. The printed circuit board of claim 7, said auxiliary module configured to receive any one of a plurality of daughter cards, each of said plurality of daughter cards further configured to receive said input and said output portions of said auxiliary module.

10. The printed circuit board of claim 9, said daughter card further configured to generate an analog DC lamp dimming signal of a predetermined range in response to a line component of said AC input signal and said supplemental input signals, said supplemental input signals further comprising digital continuous dimming signals provided by a dimming controller remote from said ballast.

11. The printed circuit board of claim 10, said continuous dimming signals further comprising daylight harvesting dimming signals.

12. The printed circuit board of claim 9, said daughter card further configured to generate an analog lamp dimming signal in response to a plurality of AC line components of said AC input signal, said line components provided by a load management controller remote from said ballast.

13. The printed circuit board of claim 12, said daughter card further comprising a demand response daughter card.

14. The printed circuit board of claim 9, said daughter card further comprising a Digital Addressable Lighting Interface daughter card configured to generate an analog lamp dimming signal within a predetermined range in response to a line component of said AC input signal and said supplemental input signals, said supplemental input signals further comprising dimming signals provided by a Digital Addressable Lighting Interface controller remote from said ballast.

15. The printed circuit board of claim 9, said daughter card further comprising an analog dimming card configured to provide an analog lamp dimming signal within a predetermined range in response to said supplemental input signals.

16. The printed circuit board of claim 9, said daughter card further comprising an analog three-wire phase control card configured to provide an analog lamp dimming signal within a predetermined range in response to a plurality of line components of said AC signal and a supplemental input signal, said supplemental input signal further comprising a phase-control signal.

* * * * *